US005649262A

United States Patent [19]

Walker et al.

[11] Patent Number: 5,649,262

[45] Date of Patent: Jul. 15, 1997

[54] FILM CLEANING APPARATUS AND METHOD

[75] Inventors: Michael Albert Chapman Walker, Fairview, Southill Rd, Chislehurst, Kent BR7 5EE; Terence Andrew Watts, London, both of United Kingdom

[73] Assignee: Michael Albert Chapman Walker, Kent, United Kingdom

[21] Appl. No.: 537,885

[22] PCT Filed: Apr. 22, 1994

[86] PCT No.: PCT/GB94/00853

§ 371 Date: Oct. 23, 1995

§ 102(e) Date: Oct. 23, 1995

[87] PCT Pub. No.: WO94/25902

PCT Pub. Date: Nov. 10, 1994

[30] Foreign Application Priority Data

Apr. 24, 1993 [GB] United Kingdom ..... 9308538

[51] Int. Cl.[6] ..... G03D 5/00

[52] U.S. Cl. ..... 396/606

[58] Field of Search ..... 354/300, 319–324, 354/317

[56] References Cited

FOREIGN PATENT DOCUMENTS

| | | | |
|---|---|---|---|
| 362896 | 11/1990 | European Pat. Off. . | |
| 2298852 | 8/1976 | France | 396/942 |
| 931653 | 7/1963 | United Kingdom | 396/627 |

*Primary Examiner*—D. Rutledge
*Attorney, Agent, or Firm*—Plevy & Associates

[57] ABSTRACT

A film cleaning apparatus has a container (32) in which a film (22) is exposed to mercury. This may be achieved by immersing the film in a mercury bath (34), exposing the film to mercury pressure jets (44,46) or a combination of both. The mercury effects removal of contamination such as dust particles and grease from the surface of the film.

37 Claims, 13 Drawing Sheets

(PRIORT ART)

FILM CLEANING APPARATUS AND METHOD

FIELD OF THE INVENTION

This invention relates to a film cleaning apparatus and method and more specifically but not exclusively to such an apparatus and method for removal of dust from cinematographic films.

BACKGROUND OF THE INVENTION

The presence of dust and dirt on cinematographic films is a considerable problem in that it impairs the projected image and can lead to scratching of the film during transport through a projector. Various methods have been considered for removal of dust and dirt from films and perhaps the simplest idea would be to attempt to simply blow particles from the film. However, this is not satisfactory as electrostatic attraction of particles to cinematographic films makes it difficult to shift such particles. If a continuous jet of air is directed at the surface of a film an air boundary layer very close to the film surface is formed and this creates a downward pressure causing particles to cling to the film surface. The smaller the particles, the greater is the hold on the surface. The higher the velocity of air used the more pressure is exerted in or by the boundary layer making small particles apparently immovable. Accordingly such an arrangement will not work satisfactorily and will not remove grease.

In current cinematographic Film Cleaners. Film is cleaned by ultrasonic vibration of the film as it is passed through a bath containing a volatile hot liquid. The ultrasonics are generated electronically, and physically coupled from a transducer via the liquid in the bath, causing vibration of the Film which removes dust, dirt and grease by surface cavitation. the Film is then passed through a drying tower which evaporates the liquid and dries the Film. However, this drying process limits the cleaning speed of the film to approximately 200 feet per minute with current solvents and is expensive due to the solvent costs. Furthermore, the solvent most commonly used in the film cleaning process is Trichloreoethane—a CFC—which is being phased out from January 1994.

The present invention seeks to provide an alternative film cleaning apparatus and method which provides significant advantages over existing film cleaners.

SUMMARY OF THE INVENTION

According to the invention there is provided a film cleaning apparatus comprising a container provided with means for exposing the surface of the film to mercury which effects removal of contamination therefrom.

The mercury may be provided as a bath through which the film is transported and/or in the form of pressure jets.

Where a bath is employed the apparatus may include a transducer for introducing vibration into the mercury in the bath for example an ultrasonic transducer.

According to another aspect of the invention there is provided a method of cleaning a film comprising the steps of feeding the film through a cleaning station exposing the film to a supply of mercury to remove contaminants therefrom and purging the film of mercury.

BRIEF DESCRIPTION OF THE DRAWINGS

In order that the invention and its various other preferred features may be understood more easily, some embodiments thereof will now be described, by way of example only, with reference to the drawings which are schematic only and in which.

DETAILED DESCRIPTION OF THE INVENTION

Figure 1:
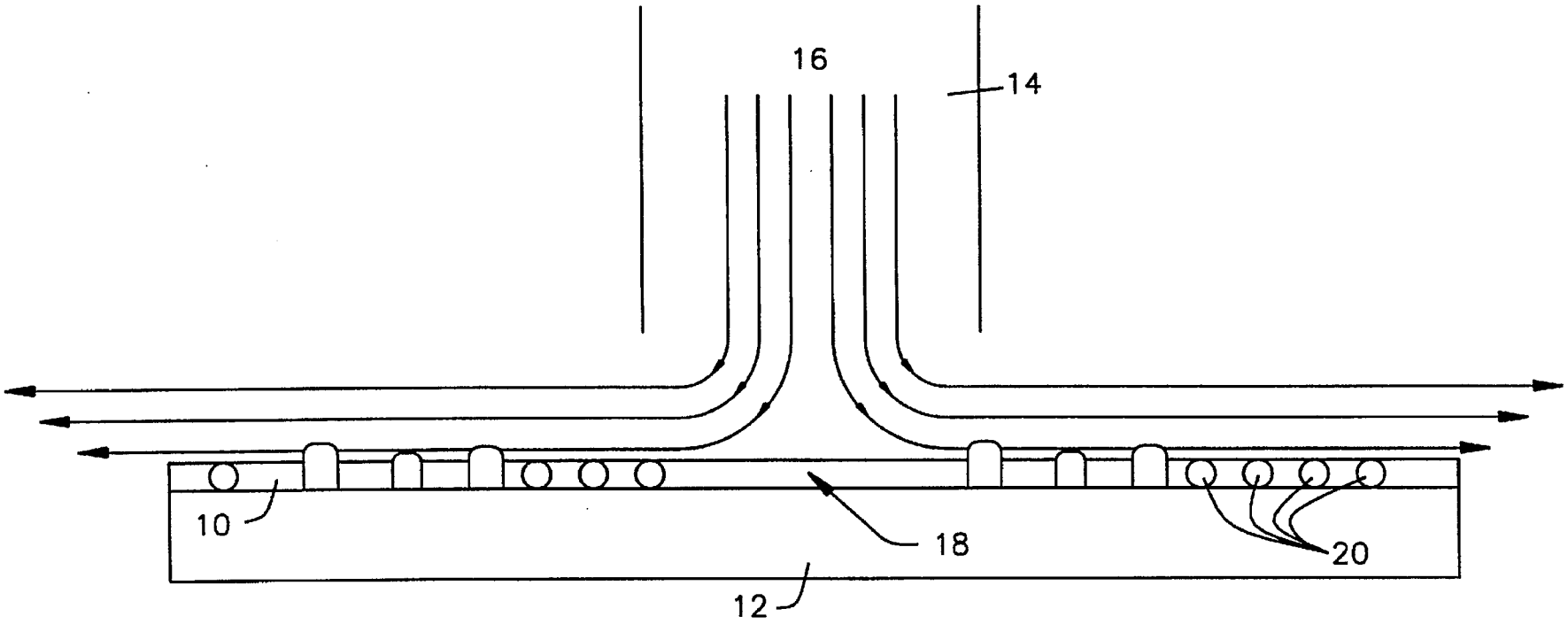
FIG. 1 is an illustration of the effect of a continuous flow of gas over a flat surface.

Throughout the description the same reference numerals will be used for similar parts.

Referring now to FIG. 1 there is shown a surface 10 of a film 12 and a channel 14 supplying, perpendicularly to the surface, a pressurized air flow 16. The flow of air which occurs, as can be seen from the lines having arrow heads, is deflected along the surface 10 of the film and sets up a boundary layer 18 as previously mentioned. This creates a downward pressure causing particles of dust 20 which are totally covered by the boundary layer to be held in contact with the surface. Only larger particles which are not fully covered by the boundary layer are blown off. Accordingly, such a technique is not suitable for efficient cleaning of the film.

Figure 2:
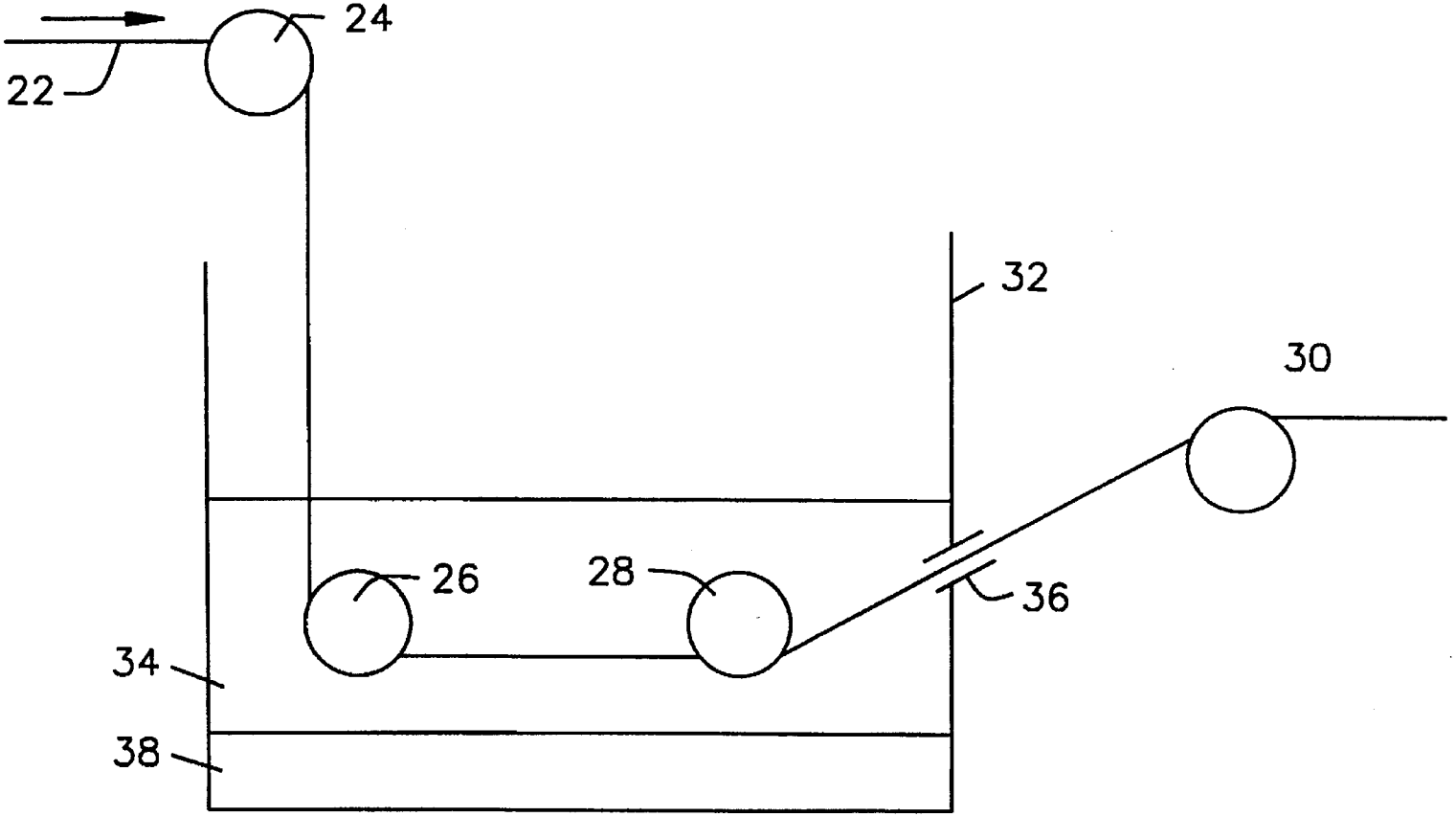
FIG. 2 shows part of a basic film cleaning apparatus employing the principles of the invention in which the film is routed through a mercury bath.

FIG. 2 shows part of a basic cleaning apparatus constructed in accordance with the invention. In this apparatus, film 22 from a storage spool (not shown) is fed in the direction of the arrow round a series of guides or rollers 24,26,28,30, through a container 32 partially filled with mercury 34 out through a sealed aperture 36 to a take up spool (not shown). The aperture is below the surface of the liquid to avoid recontamination at the surface of the mercury bath. Instead of a seal there may be arranged a mercury recovery system beyond the aperture for recycling mercury leakage from the aperture. Liquid mercury enables a uniform and intimate contact of a relatively large mass compared to dust and grease particles and it absorbs the particles. Because of the high density of the mercury relative to the dirt and grease contaminants, these contaminants rise to the surface and periodically can be extracted from the surface. The mercury bath may employ a transducer 38, which may be ultrasonic, to introduce vibration into the mercury to aid the removal of contaminants from the surface of the film.

Figure 3:
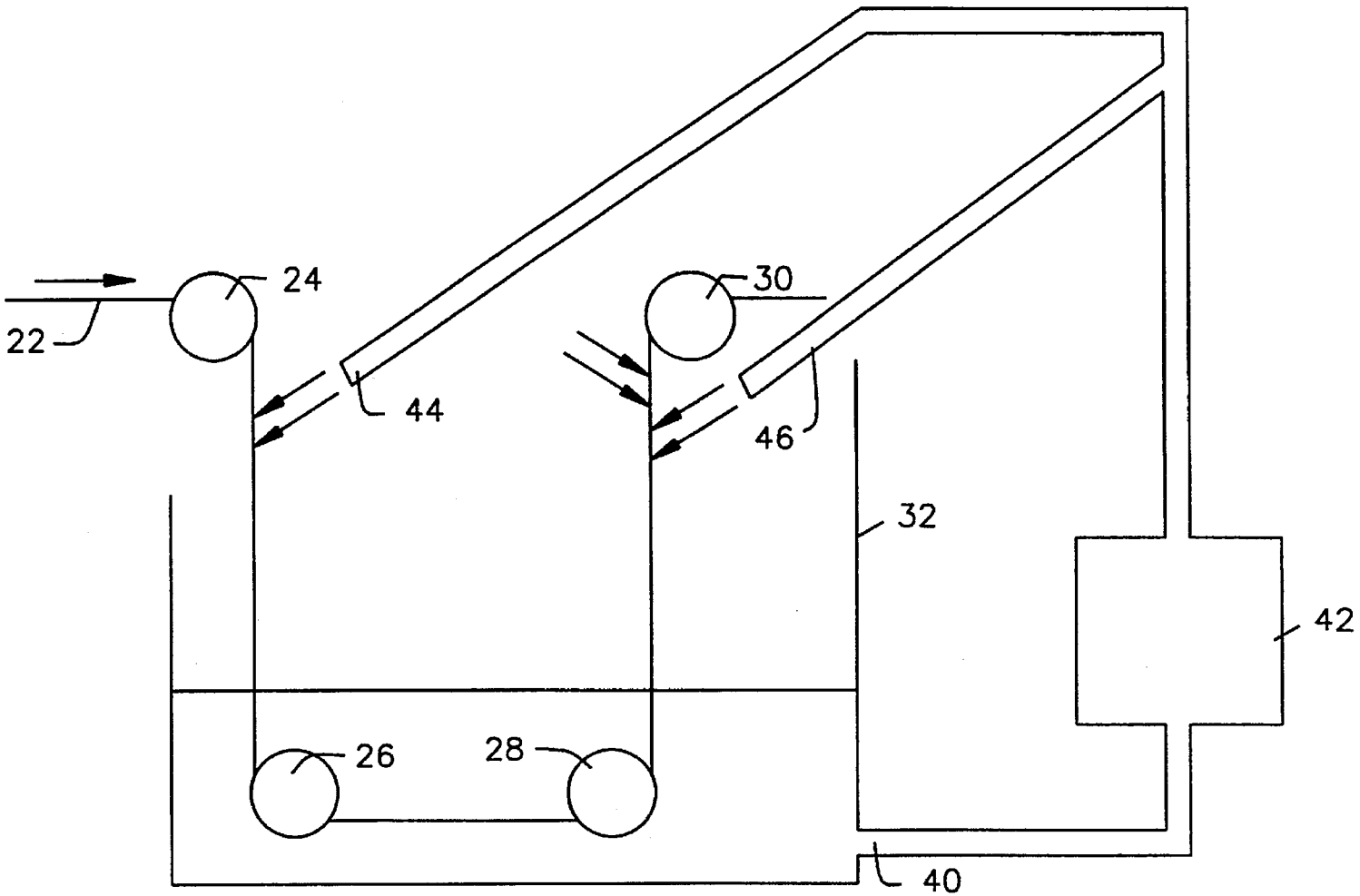
FIG. 3 shows part of an alternative film cleaning apparatus employing the principles of the invention in which the film is subjected to mercury pressure jets.
Figure 4:
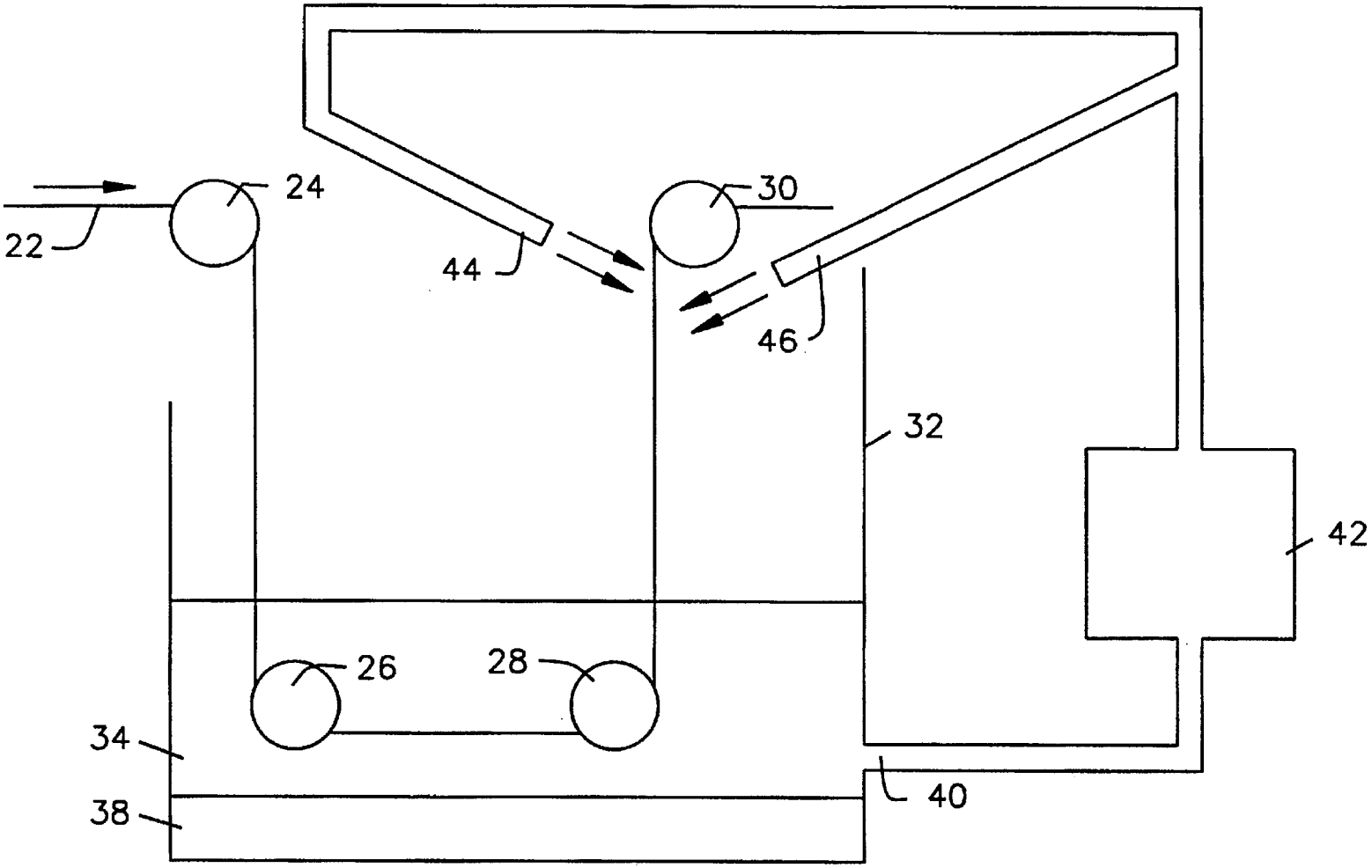
FIG. 4 shows part of another alternative film cleaning apparatus employing the principles of the invention where the film is subjected to a combination of mercury bath and pressure jet cleaning.

FIG. 3 shows an alternative arrangement in which the container 32 is continually drained of mercury through an outlet pipe 40 close to the bottom of the container. The pipe is coupled via a pump 42 to two nozzles 44,46 which are arranged to provide high pressure mercury jets onto opposite sides of the film during its passage round the guides or rollers to remove contamination from the film. Again the relatively large mass of mercury compared to dust and grease particles allows the non abrasive application of high pressure evenly over the film surface thus forcing the dust and grease from the surface of the film and allowing it to be carried away by the mercury into the bottom of the container, FIG. 4 shows another alternative arrangement which is a combination of the arrangements of FIGS. 2 & 3. Here the container is partly filled with mercury as in FIG. 2 and has the optional transducer 38. The film path is through the mercury in the bottom of the container but the film is exposed on opposite sides to the mercury pressure jets 44 & 46. The jet 44 in this instance is directed onto the film at a portion of the film path after the passage through the mercury in the bottom of the container so that any contaminants picked up from the surface are washed back into the bottom of the container.

Instead of supplying mercury to the nozzles 44 and 46 directly by the pump, mercury could be pumped to a header tank and the jets could be fed from the base of that tank by gravity. The weight of mercury is such that reasonably strong pressure jets can be produced by this means.

Figure 5:
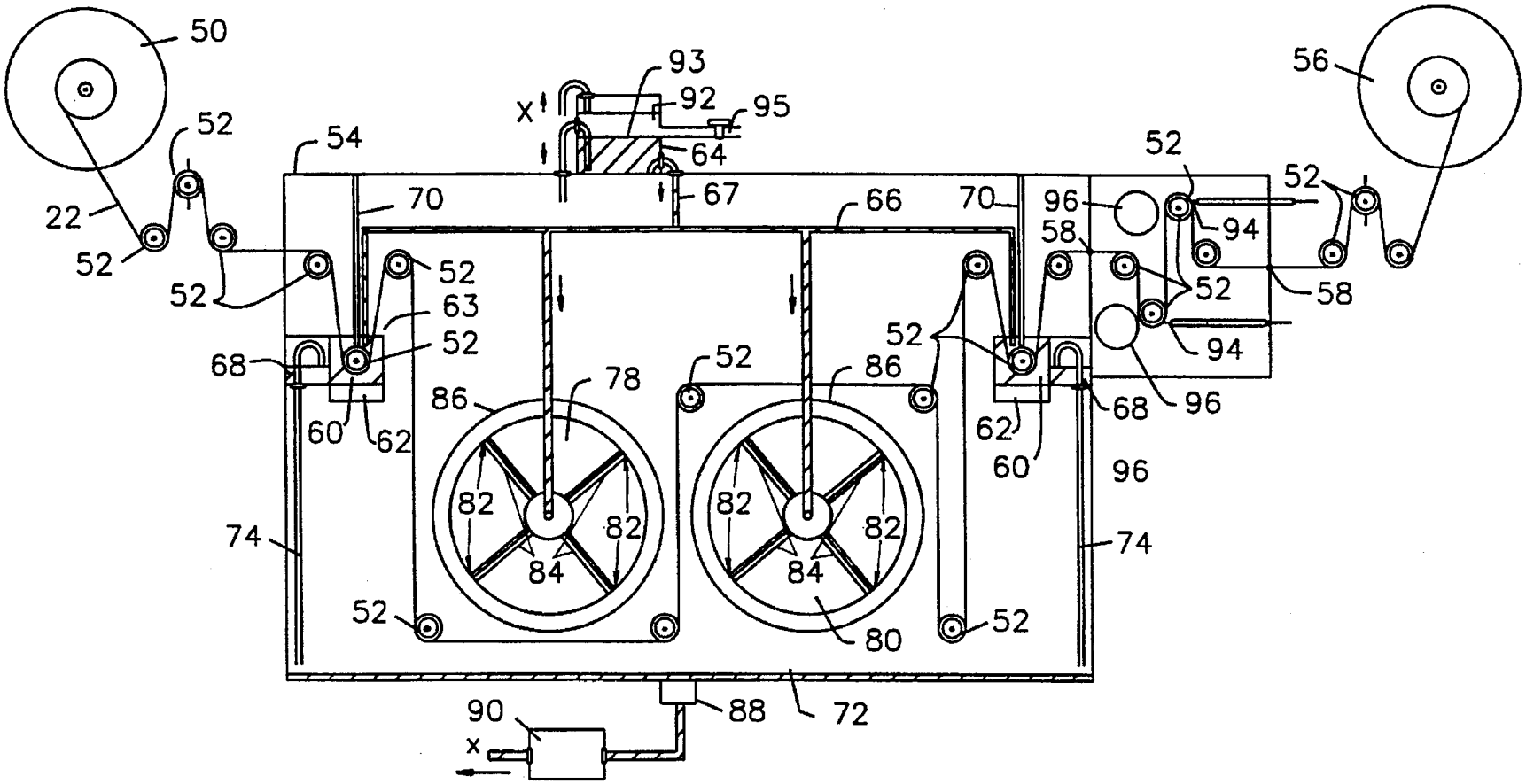
FIG. 5 shows a front schematic view of a particularly advantageous apparatus constructed in accordance with the invention employing mercury pressure jets mounted on rotatable hubs.
Figure 6:
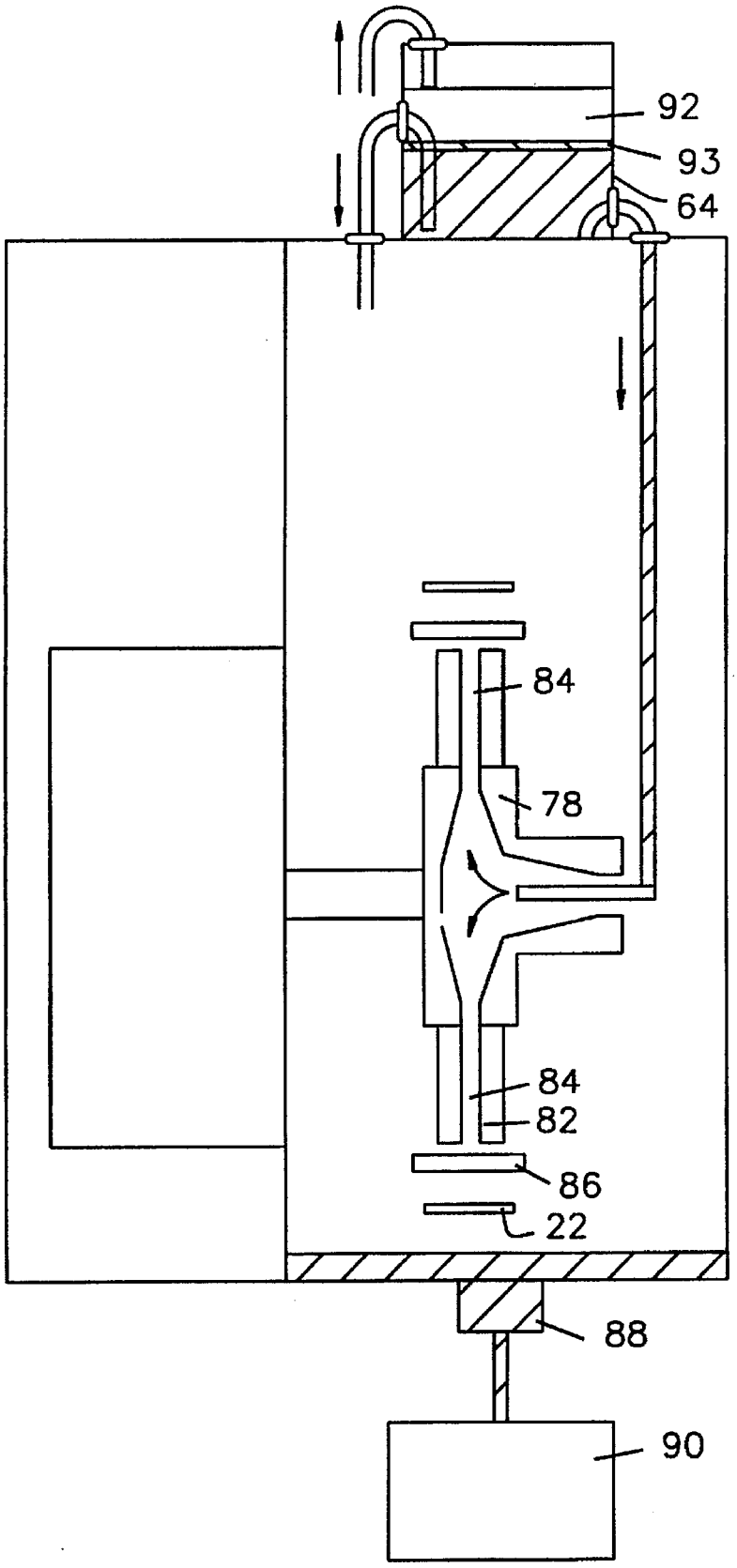
FIG. 6 shows an end schematic view of the apparatus illustrated in FIG. 5.

FIGS. 5 and 6 illustrate a particularly advantageous embodiment which employs the principle of this invention. Film 22 is fed from a film feed reel 50 over a series of film transport rollers or guides 52 through a housing 54 to a film take up roller 56. The film enters the housing through an aperture 58 in the wall of a housing 56, of for example stainless steel or plastics material, where it is routed down through a dirt and vapor trap formed by an open topped tank 60 which contains mercury. The mercury is connected to electrical earth thus eliminating static charges on the film. The tank has a transducer 62 which may operate at ultrasonic frequencies and serves to provide both a cleaning action on the film and also to act as a closure between the inner part of the tank and the aperture 58 to prevent airborne particles of mercury escaping. The tank receives a flow of mercury from a reservoir 64 along the pipeline 66 and continually overflows into an overflow container 68 on the aperture 58 side of the wall 70 of a mercury jet container portion 72 within the housing and directly into the bottom of the container portion to the other side of the wall. The overflow container 66 is linked by a pipe 74 to the inside of the container and provides a draining action of excess mercury into the container when a predetermined level is reached in the overflow container. The upper end of the pipe 74 is "U" shaped with the extremity below the level of the mercury in the overflow container so that the inner part of the tank is isolated from the aperture 58 to prevent airborne particles of mercury escaping. The film passes into the interior of the container over a guide or roller 52 and down towards the bottom of the container round another guide/roller 52 and along substantially parallel to the bottom of the container to another guide roller 52, upwardly towards the top of the container over another guide/roller 52, thereby defining a substantially "U" shaped path, along parallel to the bottom of the container to another guide/roller 52, down towards the bottom of the tank to another guide/roller 52 to define an inverted substantially "U" shaped path. The film is then routed up again over another guide/roller 52 and down through another dirt and vapor trap similar to that at the entry side of the housing, and having the same reference numerals for similar parts, out through an aperture 58 into a residue and particle trap 76 which will be hereinafter described.

The mercury in the dirt and vapor trap is again connected to earth to remove any static electrical charge and the two traps are accordingly at the same electrical potential. Rotatably mounted within the container within the "U" and inverted "U" shaped paths there is a hub assembly 78 and 80 respectively. The hub assembly is provided with means for rotation at high speed by for example an electric, or hydraulically powered, motor. Each hub is provided with four nozzles 82 directed radially outwardly and mutually angularly displaced by 90° around the hub in line with the film path. The center of each hub is supplied with mercury along the pipeline 66 from an outlet 67 from the reservoir 64 and this is linked to the nozzle by radially extending pipes 84 in the hub assembly. It will be appreciated that when the hub is rotated the mercury is jetted from the nozzles at high velocity towards the surface of the film and is caused to form very fine droplets or spray. It will be appreciated that the spray from one hub is directed onto one side of the film and that from the other hub onto the other side of the film so that both sides are cleaned. A typical hub speed is 3000 R.P.M. with a 30 cm diameter rotor. It has been found that the mercury can sometimes form larger droplets which are less beneficial to the cleaning of the film and to overcome this a fixed fine stainless steel mesh screen 86 is provided around the periphery of the hub between the hub and the film path. In practice it has been found that a twin layer mesh is particularly suitable, the first layer closest to the jet having 40 holes per line centimeter and being formed from stainless steel wires of diameter 0.125 mm and the second layer, forming a supporting layer for the first layer, having 12 holes per line centimeter and being formed from stainless steel wires of diameter 0.25 mm. The combination of the acceleration and the fine mesh screen reduces the mercury to a very fine mist with a very large surface area which then hits the film surface and removes any dirt, dust and grease. The smaller are the particles of mercury the larger is their combined surface area and the greater is their grease absorbing capability.

After the cleaning process the mercury falls to the bottom of the container where it passes through a bottom outlet 88 and is pumped by a fluid pump 90 back to the top of the mercury reservoir 64 where it passes through a layer 92 of a grease solvent into the bottom of the reservoir. A suitable grease solvent is Perchloroethylene. Dirt, dust and grease from the film will form a layer 93 on top of the mercury, due to the very high density of mercury, allowing clean mercury to be fed from the bottom of the reservoir to the nozzles on the hubs. The solvent may be drained off through an outlet 95 to remove any contaminant build up. The film passing into the residue and particle trap is routed round four guides/rollers 52 where it is subjected to filtered gas or air jets 94 directed onto top and bottom curved surfaces of the film which disrupts the boundary layer, mentioned in connection with FIG. 1, and allows dust and dirt to be blown off. In each case the jets create a strong air gas current against the direction of travel of the film and towards an exit 96 where it is extracted together with dust or mercury particles removed from the film surface into the filtration system for recycling.

Figure 7:
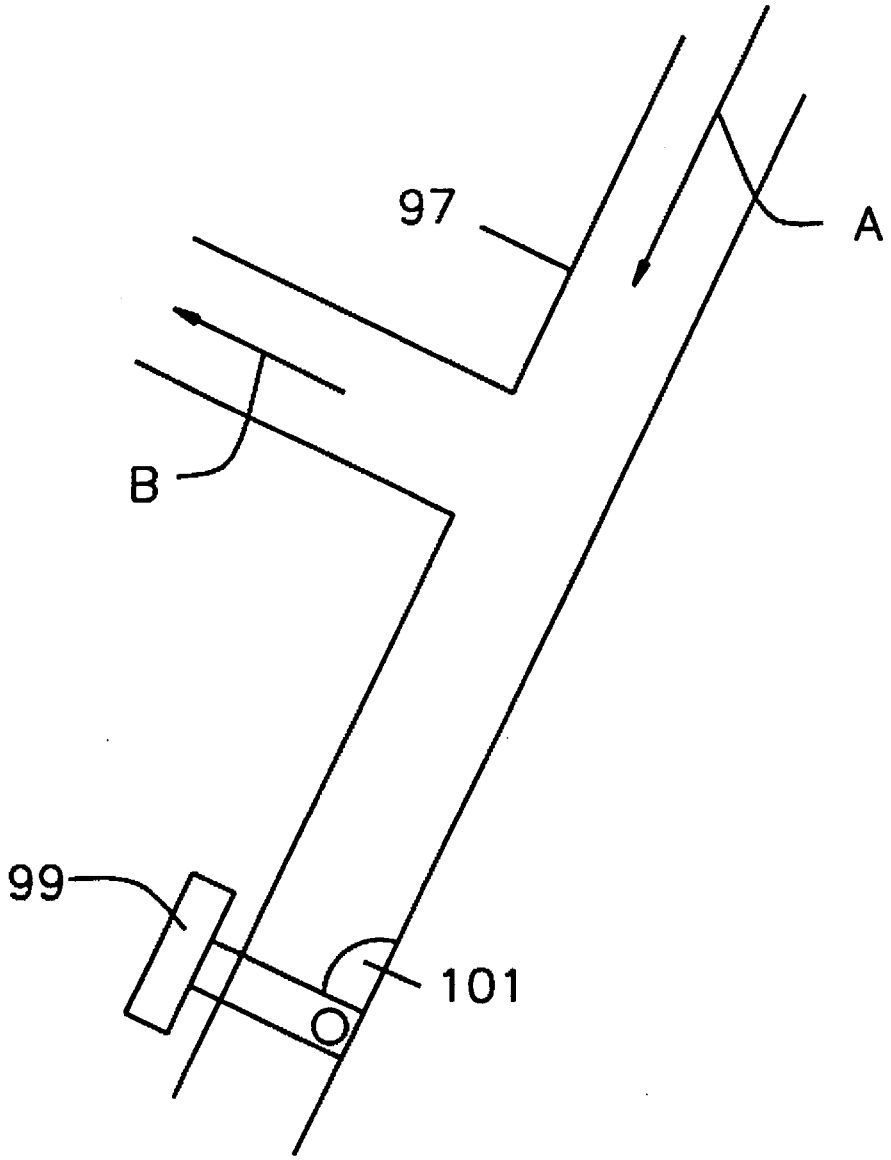
FIG. 7 illustrates an inertia trap useable in the apparatus.

The filtration system may include an inertia trap the principle of which is illustrated in FIG. 7. Air entraining dust and mercury particles is directed along a downwardly directed extraction pipeline 97 in the direction A. The pipeline has an upwardly directed branch before a closure formed by a tap 99. When the tap is closed heavy particles traveling in the direction A fall into the bottom of the trap at 101 and do not carry into the upwardly directed branch in the direction B in which the air flows to a filter for extracting light particles. The film then passes through an aperture 58 in the wall of the residue and particle trap and via three guides/rollers 52 to the take up spool 56. The arrangement described permits high cleaning speeds to be achieved because there is no capstan employed in the film feed arrangement and drying of the film is not necessary before routing to the take up spool, as is the case with volatile solvent film cleaners. A potential cleaning speed of 1000 feet per minute is possible.

It will be appreciated that there are a number of possible variations of the arrangement illustrated in FIGS. 5 & 6 which may be employed. For example instead of transferring the mercury from the bottom of the housing 54 to a raised reservoir 64, the reservoir may be disposed below the housing and receive the mercury under the action of gravity. In this configuration the pump 90 would deliver mercury from the reservoir at pressure to the pipeline 66. Instead of feeding the mercury to nozzles 78 on the hubs 78 alternative means for creating a mercury spray can be employed for example mercury could be directly sprayed under pressure into the container or the hubs could be replaced by a vaned wheel rotating at high speed onto which mercury could be projected from the feeder pipeline 66.

Figure 8:
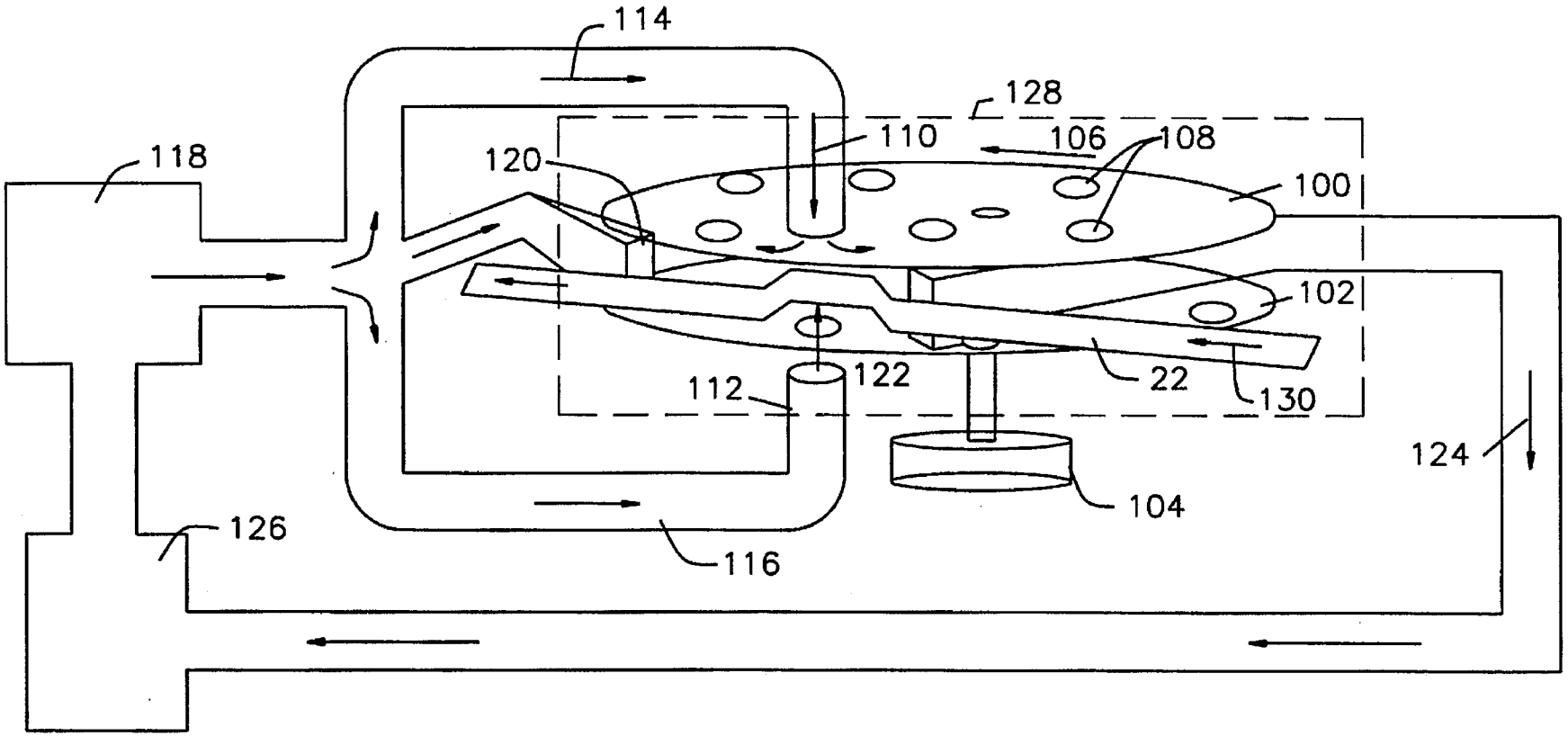
FIG. 8 is a schematic illustration of one possible film cleaning apparatus useable in the residue and particle trap section of an apparatus constructed in accordance with the invention, FIGS. 9*a* and *b* illustrate the effect of jet pressure provided by the apparatus of FIG. 8.

There are a number of alternative configurations which could be employed for cleaning the film in the residue and particle trap and some possible alternative constructions will now be described. Referring to FIG. 8, a film cleaning apparatus comprises a pair of discs 100, 102 spaced apart on the shaft of a motor 104 which when operated causes the discs to rotate in the direction of the arrow 106. The discs are each provided near to their circumference with equally spaced through apertures in the form of holes 108 disposed on a common pitch circle diameter. The holes on the disc 102 are displaced relative to the holes on the disc 100 so that they are not in alignment. At the outer face of each disc 100 and 102 there is provided a nozzle 110 and 112 which nozzles are directed towards the face and are mutually oppositely disposed and directed towards one another. The nozzles are disposed with their outlet on the same pitch circle diameter as the holes 108. The nozzles 110 and 112 are coupled by pipeline 114 and 116 to a common high speed blower 118 which forms a source of pressurized air to the nozzles. An additional nozzle 120 is also coupled to the blower 118 and is positioned to direct a flow of pressurized air between the discs 100 and 102 transversely of the flow from the nozzle 110 and 112.

Figure 9A:
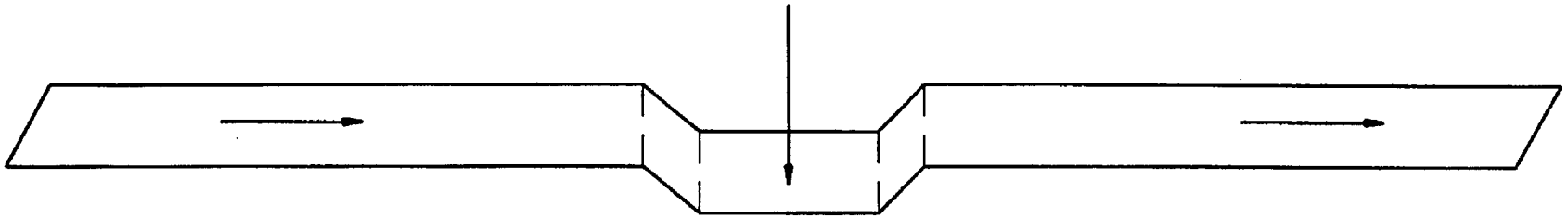
Figure 9B:
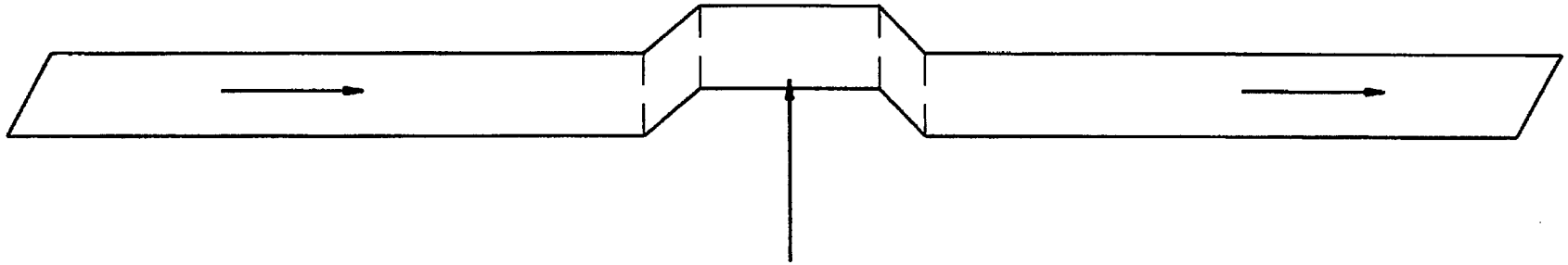

An outlet nozzle 122 is provided between the discs to the opposite side of the nozzles 110 and 112 from the nozzle 120 and this is coupled via a pipeline 124 to a dust and mercury extraction filter 126 and back to the inlet of the blower 118 to provide recirculation of air. In practice the discs and nozzles will be contained within the particle trap housing 128 illustrated schematically by a dotted line. The arrangement is such that a film 22 can be fed at high speed in the direction of arrow 130 through the housing 128 and between the discs 100 and 102 and nozzles 110 and 112 such that its opposite faces are directed one towards each nozzle. During this feed air is supplied at higher pressure from the blower 118 to the nozzles 110, 112 and 120 and the discs are rotated at high speed so that air is alternately blocked by the disc or allowed to pass through a hole 108 and a pulsating jet of air strikes each face of the film. In view of the relative offset between the holes in discs 100 and 102 pressure is only supplied to one side of the film at a time and causes deflection of the film. As illustrated in FIG. 8 a hole in disc 102 is in alignment with nozzle 112 so that the jet from nozzle 112 strikes the lower face of the film causing upward displacement. FIGS. 9*a* and *b* shows on an enlarged scale the two alternative displacements that are possible as a result of a jet from nozzle 110 and 112 respectively. It will be appreciated that this effectively causes vigorous vibration of the film thus causing the film to oscillate rapidly between two positions such that dust is shaken from the surface and the deflection prevents the establishment of a boundary layer as has been previously described in connection with FIG. 1. The released dust is now extracted by suction through the outlet nozzle 122 along the pipeline 124, cleaned in the dust extraction filter 126 and recirculated by the blower 118.

Figure 10:
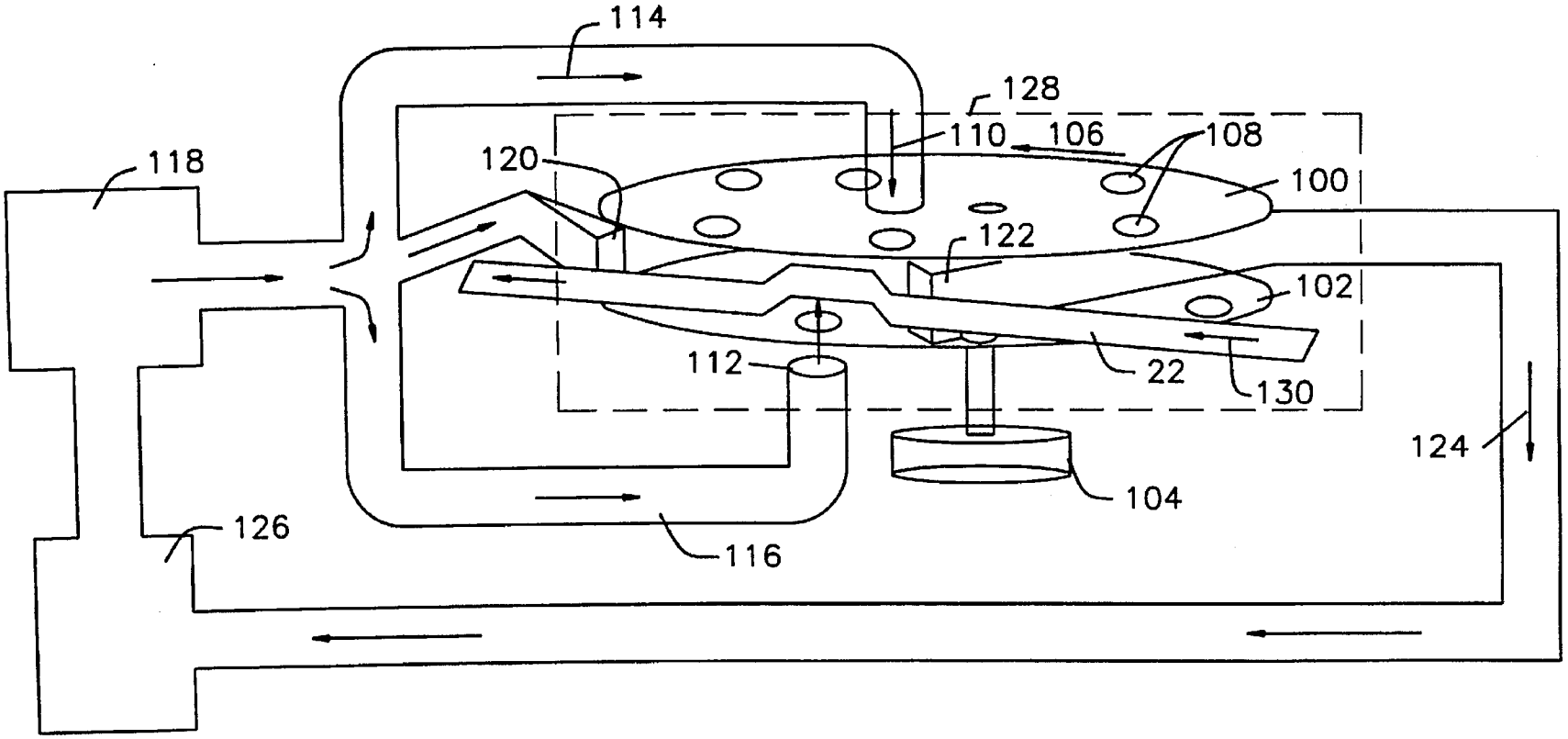
FIG. 10 is a schematic illustration showing an alternative relative location of the nozzles of FIG. 8.

FIG. 10 shows schematically a modification of the construction of FIG. 8 by providing the nozzles 110 and 112 displaced along the film path. It will be appreciated that with this arrangement it is not essential for the jets from the two nozzles to be alternately pulsed or even pulsed at the same frequency as different configurations and spacings of holes could employ variations of the relative pulsing of the two jets which may lead to improved cleaning due to harmonic generation and generation of sum and difference frequency components.

The drawings are intended to be schematic only and although the discs shown have eight holes 108 it is envisaged that there will be a multiplicity of such holes e.g. 100 or more on the same pitch circle diameter. Rotation of the motor shaft at for example 3000–6000 revolution per minute is also envisaged. It could also be advantageous to employ a combination of rotational speed and numbers of holes to induce ultrasonic vibration of the film. If the air supply is vigorous enough and the air is pulsed fast enough it is envisaged that harmonics of the fundamental pulsing frequency will be generated which will assist the cleaning process.

All of the basic systems described avoid the need for a capstan drive although this could be employed if required. A capstan drive has been found to be a potential cause of film damage. Accordingly the provision of a cleaning apparatus in which the only contact with the film surfaces are mercury and pulsed air jets eliminating the chance of contact damage with the picture area is considered to be a significant advantage. Furthermore, such an arrangements permits greater cleaning speeds to be safely attained, than that of a capstan drive system, potentially 1000 feet per minute.

Figure 11:
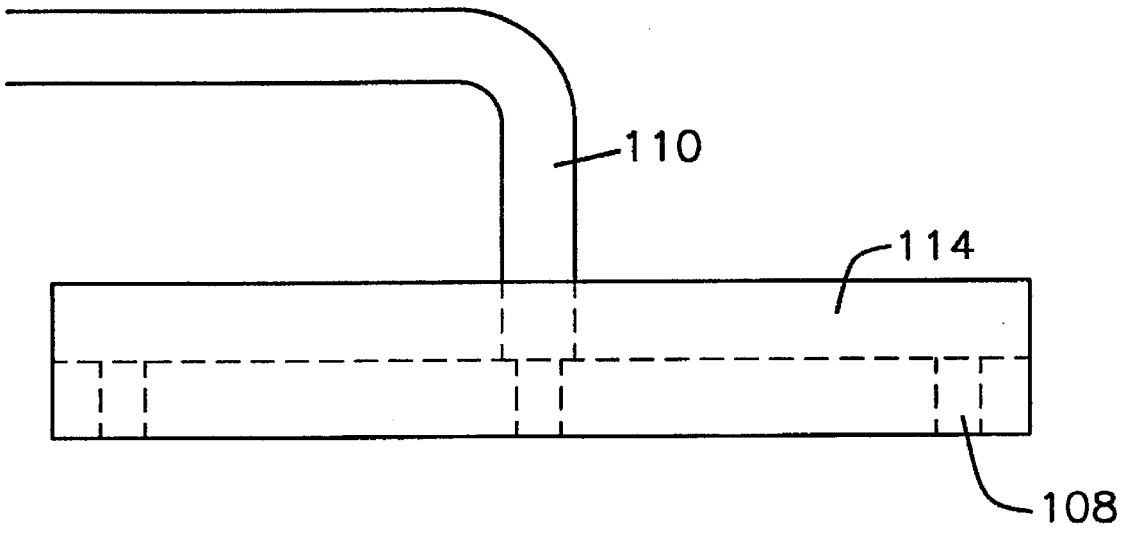
FIG. 11 is a schematic illustration of a refinement of the disc and nozzle combination shown in FIG. 8.
Figure 12:
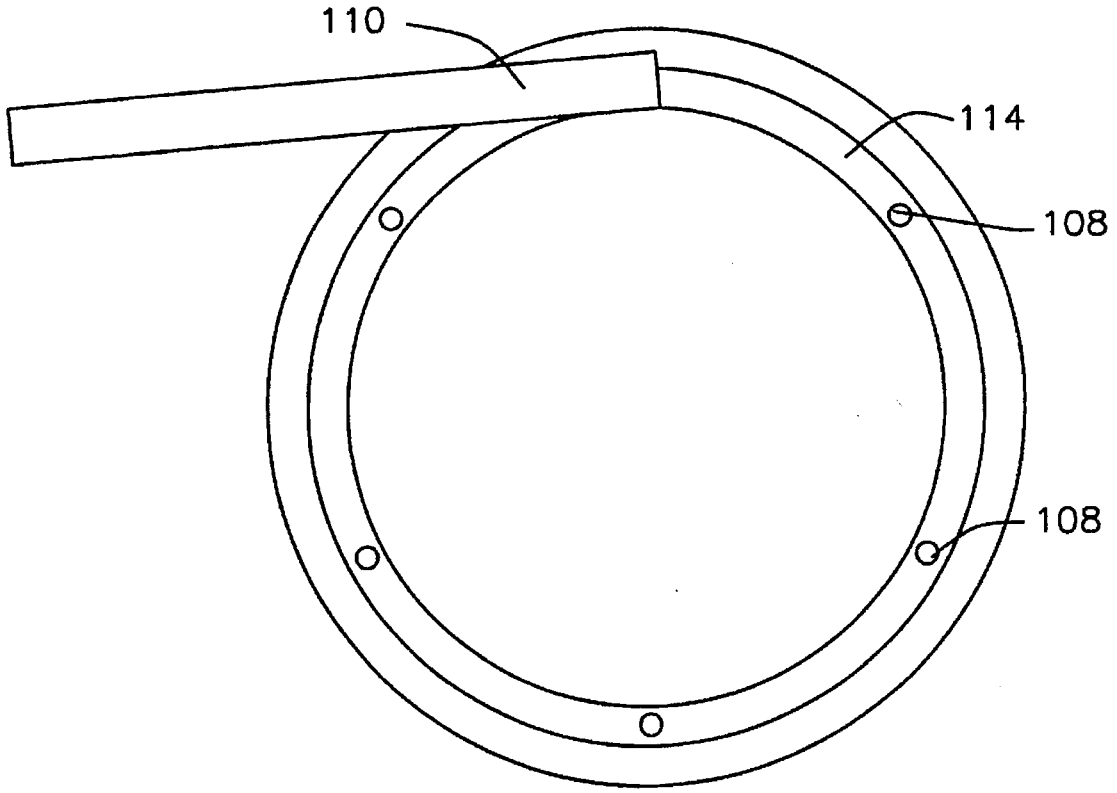
FIG. 12 is a plan view of the refinement of the disc shown in FIG. 11.

FIGS. 11 and 12 show a refinement of the system in which escape of air provided by the blower 118 is reduced by providing in each of the discs of FIG. 8 a groove 114 of the same pitch circle diameter as that of the holes and the nozzle 110 is inset into the groove with minimal clearance at sides and bottom so that escape of air is minimized.

Whilst the embodiments described employ two discs 100 and 102 it will be appreciated that a single disc or single pulsed nozzle supply can be employed with possible less efficient results.

Although the embodiments described employ a rotating disc with holes it will be appreciated that any suitable method of causing pulsation of air could be employed for example a slotted disc or multi-armed vein, or the nozzles could be each provided with a butterfly valve triggered to open and close the outlet. Furthermore in the case of jets which are offset along the film transport path each jet can be pulsed simultaneously in which case they may be fed from a common feed line incorporating means for interrupting the supply to provide common pulsation.

Figure 13:
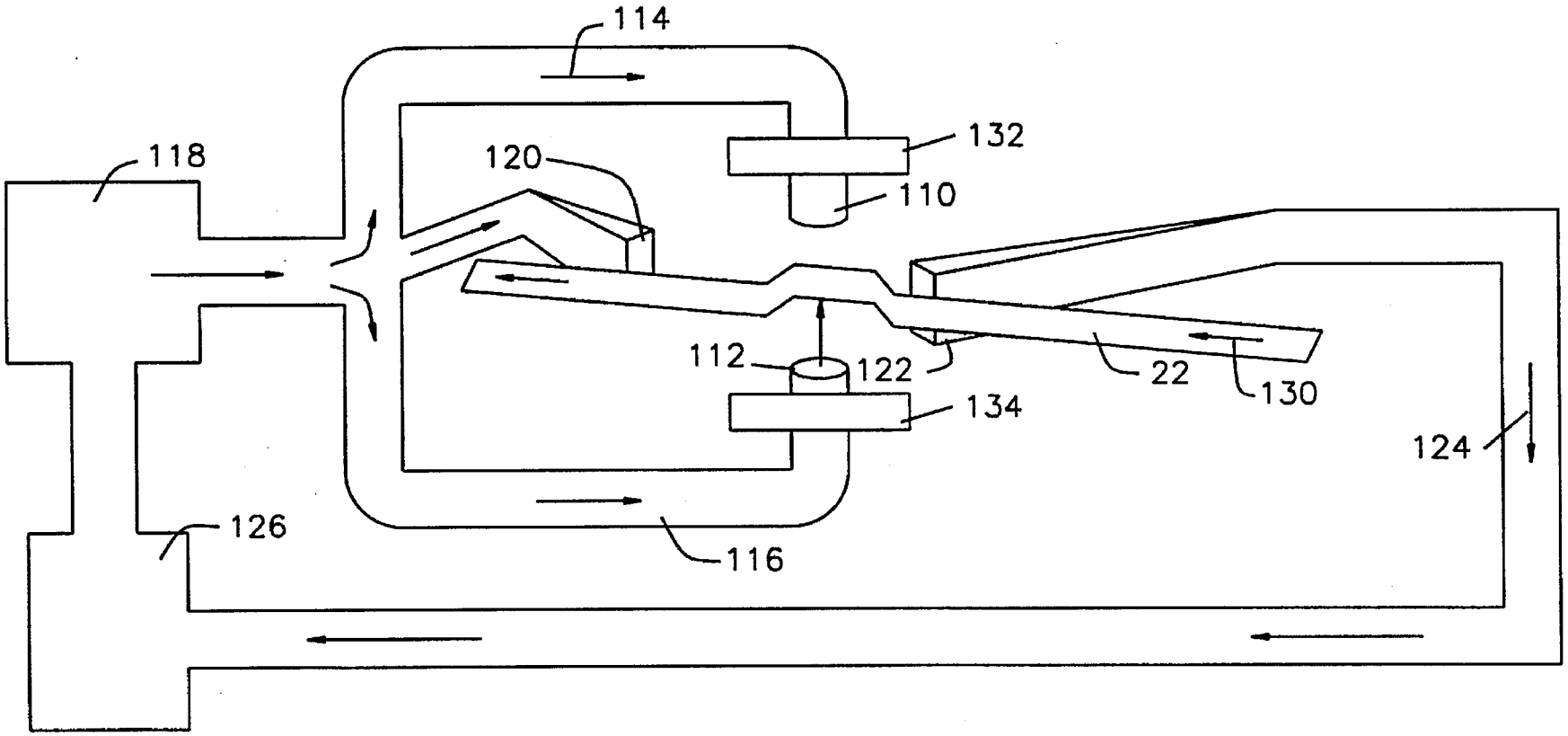
FIG. 13 is a schematic illustration of an alternative film cleaning apparatus useable in the residue and particle trap section of an apparatus constructed in accordance with the invention.

FIG. 13 illustrates an alternative means for providing a pulsating air supply in a construction similar to FIG. 7 where instead of employing apertured discs, the pipelines 114, 116 which feed the nozzles 110 and 112 are each provided with a closure valve 132, 134 which is capable of being repetitively opened and closed at high speed for example an electrically actuated solenoid valve driven by a pulsating supply of electrical current from a waveform generator which may be arranged to be variable in frequency and/or to provide a variable waveform shape to alter the opening and closing characteristics of the valve. The waveforms could be computer generated. Such a valve may have a closure element which is urged by spring means to one extreme position to close, or open, the supply of air, normally closed so that it is fail safe to block passage of air, and actuable by the pulsating supply to move against the spring, towards its other extreme position, to open or close the supply of air. Such valves normally have a limit to their opening and closing times such that the frequency of pulsation of the air supply is limited.

The frequency of pulsation can be increased by providing a plurality of such valves in series in each pipeline 114, 116 each of which valves is pulsed to close the pipeline at different instants of time thereby to provide additional interruptions of the air supply and increased pulse frequency.

Although the embodiments described employ air as the gas forming the jets it will be appreciated that any suitable gas could be employed e.g. an inert gas and any suitable source of pressure could be employed e.g. a compressor or a gas cylinder.

The film cleaning apparatus may be followed by a sticky roller system, sometimes known as a particulate transfer roller (PTR), of conventional design for removing residual dust, prior to entry onto the take up spool 56.

Although the embodiments described are intended primarily for the cleaning of cinematographic film it be appreciated that the invention is applicable to the cleaning of other films where accumulation of dust or grease is a problem for example video and audio tapes. Apparatus for such purposes is intended to fall within the scope of this invention.

We claim:

1. A film cleaning apparatus, comprising a container provided with means (32,34,26,28,30,32) for exposing the surface of the film (22) to mercury (34) which effects removal of contamination therefrom.

2. An apparatus as claimed in claim 1, wherein the means for exposing the surface of the film to mercury comprises a bath (32) through which the film is transported.

3. An apparatus as claimed in claim 2, wherein the bath (32) includes a transducer (38) for introducing vibration into the mercury (34) in the bath.

4. An apparatus as claimed in claim 3, wherein the transducer (38) is an ultrasonic device.

5. An apparatus as claimed in claim 1, further comprising transport means (50,56) for feeding film through the container.

6. An apparatus as claimed in claim 5, wherein the means for exposing the surface of the film to mercury comprises mercury pressure jets (44,46,82).

7. An apparatus as claimed in claim 6, further comprising a mercury pressure jet (44,46,82) provided on each side of a film path through the container.

8. An apparatus as claimed in claim 7, further comprising two rotatably driven hubs (78,80) on each of which hubs at least one of the mercury pressure jets (82) is provided and is radially outwardly directed.

9. An apparatus as claimed in claim 8, wherein the film path is arranged to be substantially coplanar with the rotational path of the pressure jets (82) such that the jet strikes a surface of the film.

10. An apparatus as claimed in claim 9, wherein the film path is arranged such each pressure jet is directed towards a surface of the film for a major part of the rotation of the hub (78,80).

11. An apparatus as claimed in claim 8, wherein each hub (78,80) is provided with a plurality of mercury pressure jets (82) each radially outwardly directed from the hub but mutually angularly displaced around the hub.

12. An apparatus as claimed in claim 8, further comprising a mesh (86) between the mercury pressure jets (82) and the film surface which serves to disperse the mercury jets.

13. An apparatus as claimed in claim 6, wherein an outlet (88) from the bottom of the container (54) is coupled via a pump to recycle mercury to a supply reservoir (92).

14. An apparatus as claimed in claim 13, wherein the supply reservoir (92) is coupled to the pressure jets (82).

15. An apparatus as claimed in claim 14, wherein the supply reservoir has an outlet (95) above an outlet (67) to the pressure jets which permits surface contaminants (93) to be drawn off the mercury.

16. An apparatus as claimed in claim 15, wherein the supply tank is provided on top of the mercury with a solvent layer (92).

17. An apparatus as claimed in claim 6, wherein the film path into and out of the container (54) is via a dirt and vapor trap (60).

18. An apparatus as claimed in claim 17, wherein each dirt and vapor trap comprises a mercury tank (60) a closure wall (70) which is immersed in the mercury in the tank such that the film passes through mercury during entry and exit from the container.

19. An apparatus as claimed in claim 18, wherein each tank (60) is fed continuously with a supply of mercury such that the tank overflows to purge contaminants from the surface.

20. An apparatus as claimed in claim 19, wherein the mercury which overflows each tank (60) is recycled to a storage reservoir (64) for supplying the system.

21. An apparatus as claimed in claim 5, wherein following exposure of the film to mercury, the film is routed through a residual particle trap (76) where any entrained dust or mercury particles are removed therefrom.

22. An apparatus as claimed in claim 21, wherein the residual particle trap is a chamber provided with at least one gaseous pressure jet (94) directed at the film as it passes through a cleaning station.

23. An apparatus as claimed in claim 22, wherein the gas providing the gaseous pressure jet is recirculated via means (126) for extracting dust and mercury particles.

24. An apparatus as claimed in claim 22, wherein the means for extracting mercury particles comprises an inertia trap (97).

25. An apparatus as claimed in claim 22, wherein the film transport means is arranged to feed the film through a cleaning station and means (100, 102) is provided for pulsing the jet of gas supplied thereto.

26. An apparatus as claimed in claim 25, wherein the film transport means (50,56) is arranged such that film (22) in the cleaning station can be deflected by the pulsations of gas thereby to induce vibration of the film.

27. An apparatus as claimed in claim 26, wherein the means for providing a pulsating jet of gas to the surface of the film comprises a channel (114) provided with a nozzle (110) directed at one face of the film (22).

28. An apparatus as claimed in claim 27, wherein a second nozzle (112) is provided directed at the opposite face of the film.

29. An apparatus as claimed in claim 28, wherein the nozzles (110,112) are directly opposed one on each side of the film path.

30. An apparatus as claimed in claim 28, wherein the nozzles (110,112) are relatively displaced along the film path.

31. An apparatus as claimed in claim 28, wherein the supply of gas from the two jets (110,112) is arranged to be alternately pulsed.

32. An apparatus as claimed in claim 27, wherein an additional nozzle is arranged to provide a continuous through flow of gas through the cleaning station to extract the particles.

33. An apparatus as claimed in claim 25, wherein in the cleaning station there is provided a disc (100) rotatable by a drive means (104) the surface of which disc is located adjacent the nozzle (110) and the film (22), which disc has at least one aperture (108) such that a continuous source of gas pressure from the nozzle is caused to be repetitively passed to the film surface through the at least one aperture and interrupted by the surface of the disc to effect pulsation of the gas supply during rotation of the disc.

34. An apparatus as claimed in claim 33, wherein two nozzles (110,112) are employed and a second disc (102) having at least one aperture is provided to effect pulsation of the supply to an opposite surface of the film.

35. An apparatus as claimed in claim 34, wherein the two discs (100,102) are driven contemporaneously on a common drive shaft.

36. An apparatus as claimed in claim 35, wherein the at least one aperture on each of the two discs are mutually offset such that the supply of gas to opposite faces of the film occurs at different instants in time.

37. A method of cleaning a film comprising the steps of feeding the film through a cleaning station exposing the film to a supply of mercury to remove contaminants therefrom and purging the film of mercury.

* * * * *